US007180428B1

(12) United States Patent
LeVan et al.

(10) Patent No.: US 7,180,428 B1
(45) Date of Patent: Feb. 20, 2007

(54) COMPACT RADAR VEHICLE SPEED MONITOR

(76) Inventors: Martin LeVan, 31 Margarita Ave., Camarillo, CA (US) 93012; Thomas Costan, 1403 Broadway St., Burbank, CA (US) 91504

( * ) Notice: Subject to any disclaimer, the term of this patent is extended or adjusted under 35 U.S.C. 154(b) by 112 days.

(21) Appl. No.: 10/790,682

(22) Filed: Mar. 3, 2004

(51) Int. Cl.
*G08G 1/01* (2006.01)

(52) U.S. Cl. ..... 340/936; 340/901; 340/902; 340/905; 340/908; 340/944; 701/118; 701/119

(58) Field of Classification Search ..... 340/901, 340/902, 905, 908, 933, 934, 988, 989, 937, 340/936, 931, 944; 362/812, 414; 701/118, 701/119
See application file for complete search history.

(56) References Cited

U.S. PATENT DOCUMENTS 3,549,958 A * 12/1970 Margolien ..... 257/717
3,680,043 A * 7/1972 Angeloni ..... 340/936
3,729,706 A * 4/1973 Hein ..... 340/908
4,173,010 A * 10/1979 Hoffmann ..... 340/937
5,159,345 A * 10/1992 Young ..... 342/104
5,317,311 A * 5/1994 Martell et al. ..... 340/905
5,510,793 A 4/1996 Gregg, III et al.
5,525,996 A 6/1996 Aker et al.
5,546,091 A 8/1996 Haugen et al.
5,565,871 A 10/1996 Aker et al.
5,570,093 A 10/1996 Aker et al.
5,659,290 A * 8/1997 Haeri ..... 340/441
5,691,724 A 11/1997 Aker et al.
5,699,056 A * 12/1997 Yoshida ..... 340/905
5,815,092 A 9/1998 Gregg, III et al.
5,935,190 A * 8/1999 Davis et al. ..... 701/119
6,046,686 A * 4/2000 Mitchell et al. ..... 340/936
6,115,834 A 9/2000 Jen et al.
6,384,740 B1 * 5/2002 Al-Ahmed ..... 340/936
6,427,369 B1 * 8/2002 Durinzi et al. ..... 40/564
6,574,548 B2 * 6/2003 DeKock et al. ..... 701/117

* cited by examiner

*Primary Examiner*—Jeffery Hofsass
*Assistant Examiner*—Edny Labbees
(74) *Attorney, Agent, or Firm*—James Creighton Wray; Robert W. Gibson

(57) ABSTRACT

A display indicates speed in GREEN when the approaching vehicle is traveling below or equal to the user set compliance speed. The primary display flashes RED when the approaching vehicle is exceeding the preset compliance speed. A rear mounted control panel and LCD display is provided for easy entry of compliance speed, operational settings and data recovery. The rear control panel is used for the following: set compliance speed; set max speed cutoff; retrieve traffic count; retrieve average speed; retrieve number of violations; retrieve maximum speed recorded; display battery status. Automatic dimming of the primary display is provided during night use.

20 Claims, 3 Drawing Sheets

COMPACT RADAR VEHICLE SPEED MONITOR

BACKGROUND OF THE INVENTION

Trailer-mounted radar operated speed indicators are used on highways in the U.S. The indicators are expensive and require movement by trucks.

Needs exist for improved, less expensive portable vehicle speed monitors.

SUMMARY OF THE INVENTION

The present invention measures and records the speed of oncoming vehicles with radar technology. A primary display shows the indicated speed in both high visibility red and green. The display indicates speed in GREEN when the approaching vehicle is traveling below or equal to the user set compliance speed. The display indicates speed in flashing RED when the approaching vehicle is traveling above the user set compliance speed.

A rear mounted control panel and LCD display is provided for easy entry of compliance speed, operational settings and data recovery. The rear control panel is used for the following:

Set compliance speed,
Set max speed cutoff,
Retrieve traffic count,
Retrieve average speed,
Retrieve number of violations,
Retrieve maximum speed recorded, and
Display battery status.

Automatic dimming of the primary display is provided during night use. An internal photocell sensor is used to read the ambient light level and to drive the luminance of speed display to an appropriate level by increasing the brightness during daylight and reducing brightness during nighttime operation. This feature also prevents "night blindness" due to an overly bright condition.

The apparatus has compact size. A portable, lightweight, rechargeable battery operates and is completely self-contained in the display case.

The invention provides a state-of-the-art compact radar speed display that effectively calls motorists' attention to their driving speed. The unique two-color LED digital segmental display shows the approaching vehicle speed. Bright green speed indication is displayed when the approaching vehicle is in compliance with the preset speed limit. Bright flashing red speed numbers are displayed when drivers exceed posted or preset speeds.

The new invention is an inexpensive and effective enforcement method for communities to control local speed without tying up police officers. Ideal uses include residential communities and homeowners associations, school crossings and road construction sites.

Additional settings include an "anti-race" function to prevent intentional use of the monitor to measure drag racing. When an approaching vehicle increases speed more than ten miles per hour, the display shuts off.

The compact size (approximately 12"×12") weatherproof case is mounted on a portable stand or can be clamped on a standard 4" pole. The traffic instrument is battery powered and operates for twelve hours on a single charge. The built-in charger allows overnight recharging. An optional solar panel recharges the battery during daylight. A pole mount clamp permits permanent installation above traffic.

The visible range is about 500–600 feet. The weight is approximately 25 lbs. A cable lock is available to prevent theft.

The "approach only" sensor prevents false radar readings from traffic moving away from the monitor.

The basic unit includes a portable stand, a battery and a charger. Pole mount clamps and solar panels are options.

A controller is mounted on the base for controlling numerical indications on the display. A settable compliance speed control is connected to the controller for setting compliance speed and differentiating from acceptable overspeeds. A speed sensor is connected to the controller for sensing speed of approaching vehicles and providing the sensed speed to the controller.

Preferably the indicator changes between red and green depending on whether the speed of the approaching vehicle is above, at, or below the set compliance speed. When indicating overspeed, the indicator pulses or flashes with over speed information.

In a preferred embodiment, the indicator has a segmental digital display for illuminating segments and displaying side-by-side numbers. Preferably each segment is capable of producing red or green light.

In one preferred system, each segment includes light-emitting diodes for producing light selectively in green or red wavelengths.

Preferably the light-emitting diodes in each segment are arranged in arrays.

In one embodiment, each segment has relatively bright light emitters for selectively illuminating the segments and colored light emitters for illuminating the segments with color. In one embodiment the apparatus has lights for illuminating the support with color.

Non-volatile memory is connected to the speed indication for storing information of time, number of vehicle speeds sensed, number of vehicle overspeeds sensed, and average vehicle speed.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
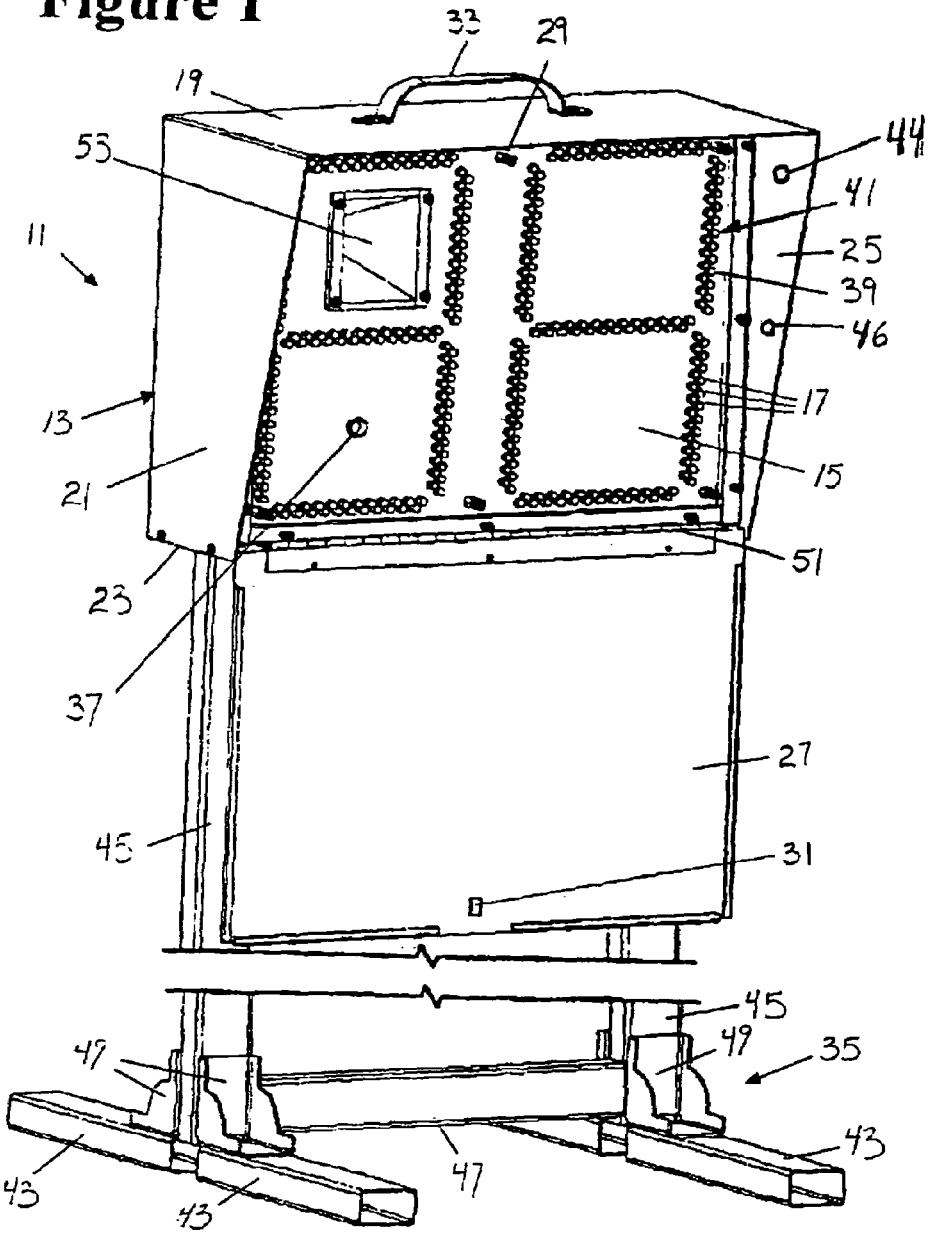
FIG. 1 is a front perspective view of the new speed monitor on a stand.

Referring to FIG. 1, the speed monitor is generally referred to by the numeral 11. A case 13 holds a support 15 on which indicators 17 are mounted. Individual indicators 17 are formed as segments 39 of a seven-segment digit 41. Two seven-segment digits 41 are provided for displaying two numbers. The case 13 has top 19, sides 21 and bottom 23 panels. A hood 25 screens the indicators 17 from sunlight to make them more readable. A cover 27 closes the front of the case 13 along a hinge 51. Preferably, the hinge 51 connects the cover 27 to the base 23 of the case 13. The cover 27 is secured in a closed position by passing a locking mechanism 29, located on the support 15, through an opening 31, located on the cover 27. The case 13 has a handle 33 for easy movement of the monitor 1.

The case may be located on a stand 35. The speed monitor 11 has a light sensor 37 that controls the intensity of the indicators 17. The light sensor 37 is a photocell located on the support 15 for matching LED brilliance to ambient light. Preferably, the light sensor 37 is located in the lower left corner of the support 15 within a digit 41.

The stand 35 has one or more base supports 43, one or more vertical members 45, and one or more horizontal strengthening members 47. The various members 43, 45, 47 may be welded together, attached with nuts and bolts, attached with joint members 49 or otherwise connected to one another. The stand 35 may be of various heights depending on the location and type of use.

A radar wave guide antenna 53 is located on the support 15. Preferably, the antenna 53 is located in the upper left of the speed monitor 11 within a digit 41. When the monitor 11 is positioned on a stand along the side of a street, the antenna 53 measures the speed of oncoming vehicles.

Figure 2:
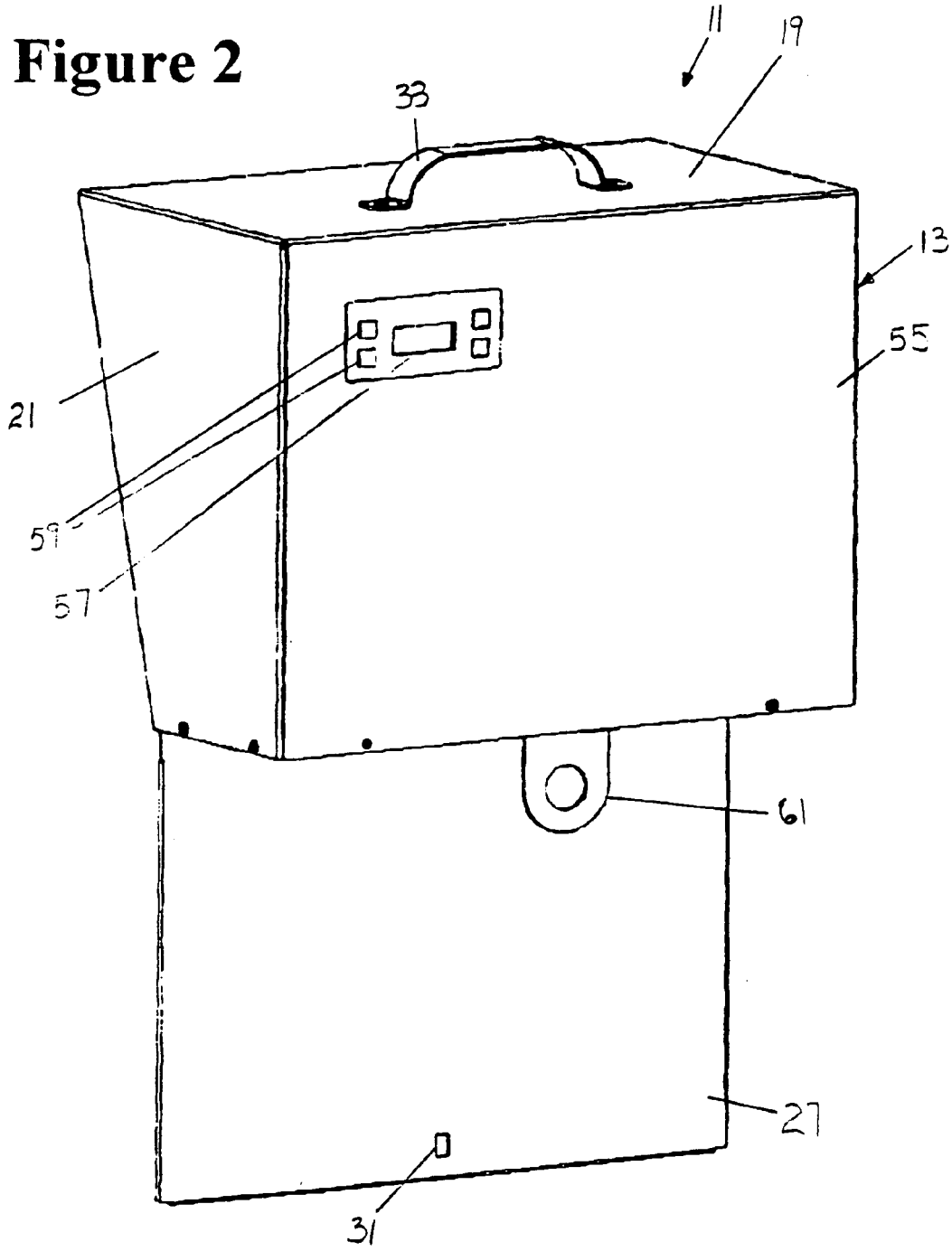
FIG. 2 is a rear perspective view of the new speed monitor.

FIG. 2 shows the rear side 55 of the monitor 11. The case 13 has a liquid crystal display 57 and control buttons 59. The control buttons 59, which may be push buttons, allow a user to set various parameters for the speed monitor 11. Preferably, there are four control buttons 59. Options include speed setting, for setting the compliance speed, and an anti-race cutoff, above which the digits 41 display no speeds. The purpose of the race cutoffs function is to not allow misuse of the speed monitor 11 and to discourage speeding. Selections and settings are shown on the liquid crystal display 57.

The control buttons 59 control all menu options, including the display of accumulated statistics and information. The liquid crystal display 57 shows the number of vehicles that have passed the monitor 11 during a given recording period. Other statistics include the number of overspeed vehicles, and the average speed. The control buttons 59 are manipulated to select the particular time periods or hours for which the reports are given.

The case 13 is mounted on a stand 35 by using a security cable connected to a tie down 61 on the backside 55 of the monitor 11. This helps to deter thefts of the monitor 11. Inner parts of the monitor 11 include as a battery, a radar transceiver for the wave guide antenna 53, and a processor. The light sensor 37 is connected to the processor for controlling the brightness of the indicators 17. The processor controls the main digit display 41 and the liquid crystal display 57. A memory retains and records information on the times of the counts and the numbers of vehicles, the average speeds during time periods, and the number of overspeeds during time periods. Those numbers may be output and downloaded from the memory to a portable device. An optional solar panel on the top of the case 13 charges the battery with solar power.

Figure 3:
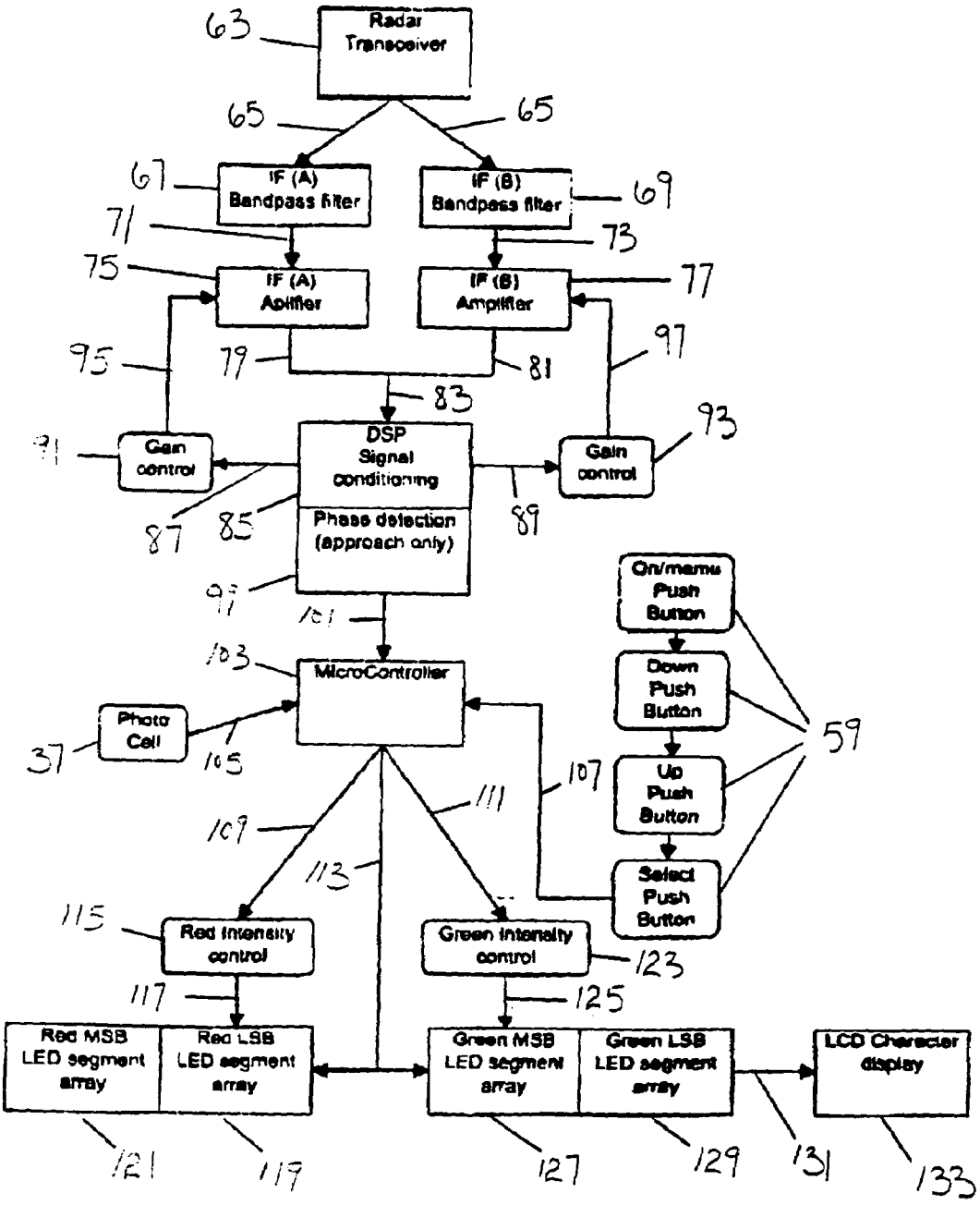
FIG. 3 is a flow diagram of the operation of the new speed monitor.

FIG. 3 shows a flow chart of the operation of the vehicle speed monitor 11. The system of the present invention uses a classic Doppler frequency shift to determine the speed of oncoming vehicles. A radar transceiver 63, or a similar device, receives input from the radar wave guide antenna 53. The signal 65 from the radar transceiver 63 is passed through one of two alternative bandpass filters 65 depending on the characteristics of the signal 65. The filtered signals 71, 73 then pass to alternative amplifiers 75, 77, respectively. The amplified signals 79, 81 are combined 83 before being sent to a DSP 85 for signal conditioning. If required, signals 87, 89 from the DSP 85 are sent through gain controls 91, 93 and then the signals 95, 97 are sent back to the alternative amplifiers 75, 77. After signal conditioning is complete the completed signal is sent through phase detection 99 to eliminate signals that are receding from the monitor 11.

The approach only signals 101 are sent to a microcontroller 103. The microcontroller 103 also receives input signals 105, 107 from the light sensor 37 and control buttons 59, respectively. Output from the microcontroller 103 is split into three signals 109, 111, 113. The first signal 109 is sent to a red intensity control 115. An output signal 117 from the red intensity control 115 passes to a red LSB LED segment array 119 that is connected to a red MSB LED segment array 121. The second signal 111 is sent to a green intensity control 123. An output signal 125 from the green intensity control 123 passes to a green LSB LED segment array 127 that is connected to a green MSB LED segment array 129. The third signal 113 from the microcontroller 103 is sent to a signal connecting the red 119, 121 and green 127, 129 arrays. Output 131 from the red 119, 121 and green 127, 129 arrays is sent to a LCD character display 133.

Possible power sources for the monitor 11 of the present invention include solar power and/or a 12-volt battery power supply.

Each digit 41 of the present invention is made up of multiple high brightness red LEDs and a corresponding number of high brightness green LEDs per each of the seven segments 39 for each digit 41. The components of each digit 41 are similar.

When a vehicle is over speed, the digits 41 will be displayed in flashing red. When the vehicle is compliant with the set speed, the digits 41 will be displayed in green.

The individual segments 39 of the digits 41 may be diffusers or lenses behind which arrays of low power, high output LED's are arranged. Dual color LED's may be used, or two arrays of different color LED's may be used behind each diffuser or lens segment. Bright lights may be used to augment the output lumens during daylight hours.

Varied bright lights may be used with the colored lights to light the numbers as well as the colors during daylight or evening hours. When the green lights are displayed for showing speed within the set compliance speed, the lights are steady. When red lights are displayed for speeds above the compliance speed, the lights flash. Alternatively, the entire inside of the hood may be lit with the varied color lights, numbered 44, or the mounting surface may be backlighted with various colored lights, numbered 46. One of the key elements of a part of the invention is that the light indications change color and change pulse rates according to comparisons of the speed with the set speed.

Preferably, the microcontroller 103 turn off the main displays 41 upon sensing rapid increases of speed on oncoming vehicles, which is indicative of racing or intentionally measuring fast speeds. That temporarily disables the indicators 17 and prevents their misuse, and prevents racing speeds from influencing average speeds. The system may be programmed with input buttons 59 to save the racing speed measurements and times of occurrence.

In preferred embodiments, the stand 35 extends into the case 13, connecting the stand 35 to the case 13 at a location within the locked portions of the case 13. This makes disassembly and removal of the stand 35 or case 13 difficult.

While the invention has been described with reference to specific embodiments, modifications and variations of the invention may be constructed without departing from the scope of the invention, which is defined in the following claims.

The invention claimed is:

1. A compact, easily transportable radar vehicle speed monitor apparatus, comprising a casing including an open front, a rear panel, a top panel, a pair of side panels and a bottom panel, a speed indicator support mounted on the casing, numerical speed indicators mounted on the support, the top and side panels extending outwardly beyond the speed indicator support and forming a hood for screening the numerical speed indicators from sunlight, a cover hingedly attached to the casing base panel for selectively closing the front of the casing, a power supply connected to the numerical speed indicators for energizing the numeral speed indicators, a display differentiator connected to the numerical speed indicators for differentiating displays on the support, red and green indicators on the numerical speed indicators for indicating overspeed or compliant speed respectively, wherein the indicators change between flashing red and steady green displays responsive to whether the speed of approaching vehicles is above, at or below a set compliance speed.

2. The apparatus of claim 1, further comprising a controller for controlling numerical indications on the display, a set compliance speed control connected to the controller for setting compliance speed and differentiating overspeed, and a speed sensor connected to the controller for sensing speed of approaching vehicles and providing the sensed speed to the controller.

3. The apparatus of claim 1, wherein the indicator comprises a segmental digital display for illuminating segments and displaying side-by-side numbers, and wherein each segment comprises red and/or green light.

4. The apparatus of claim 3, wherein each segment includes light-emitting diodes for producing light selectively in green or red wavelengths.

5. The apparatus of claim 4, wherein the light-emitting diodes in each segment are arranged in arrays.

6. The apparatus of claim 3, wherein the each segment has relatively bright light emitters for illuminating the segments and colored light emitters for illuminating the segments with color.

7. The apparatus of claim 1, wherein the hood has varied color lights lighting the entire inside of the hood, said lights flashing red to indicate overspeed and steady green to indicate compliant speed.

8. The apparatus of claim 2, further comprising a memory connected to the controller for storing information of time and number of vehicles, number of vehicle speeds sensed, number of vehicle overspeeds sensed, and average vehicle speed.

9. A method of speed monitoring, comprising providing compact, easily transportable radar vehicle speed monitor with a case including an open front, a rear panel, a top panel, a pair of side panels and a bottom panel and a speed indicator support mounted on the case, providing numerical speed indicators mounted on the support with the top and side panels extending outwardly beyond the speed indicator support forming a hood for screening the numerical speed indicators from sunlight, providing a cover hingedly attached to the base panel for selectively closing the front of the case, providing a power supply connected to the numerical speed indicators for energizing the numeral speed indicators, providing a display differentiator connected to the numerical speed indicators for differentiating displays the support and providing red or green indicators for indicating overspeed or compliant speed in distinct ways, and changing the indicators between flashing red and steady green depending on whether the speed of an approaching vehicle is above, at or below a set compliance speed.

10. The method of claim 9, further comprising providing a controller for controlling numerical indications on the display, providing a set compliance speed control connected to the controller for setting compliance speed and differentiating overspeed, and providing a speed sensor connected to the controller, sensing speed of approaching vehicles, and providing the sensed speed to the controller.

11. The method of claim 9, further comprising providing a segmental digital display for illuminating segments and displaying side-by-side numbers, and producing red or green light in each segment.

12. The method of claim 11, further comprising providing light-emitting diodes in each segment for producing light selectively in green or red wavelengths.

13. The method of claim 12, further comprising providing the light-emitting diodes in each segment arranged in arrays.

14. The method of claim 11, further comprising providing relatively bright light emitters in each segment, and illuminating the segments with the bright light emitters and the colored light emitters for illuminating the segments with color.

15. The method of claim 9, further comprising providing the hood with varied color lights, lighting the entire inside of the hood with said lights, lighting the lights flashing red to indicate overspeed and steady green to indicate compliant speed.

16. The method of claim 10, further comprising providing a memory connected to the controller for storing information of time and number of vehicles, number of vehicle speeds sensed, number of vehicle overspeeds sensed, and average vehicle speed, racing speed measurements and times of occurrence, and providing an output from the memory.

17. The apparatus of claim 4, wherein the light-emitting diodes are dual color light-emitting diodes.

18. The apparatus of claim 1, wherein the casing includes a handle affixed to the top panel for easy movement of the monitor apparatus.

19. The method of claim 12, further comprising providing light-emitting diodes that are dual color light-emitting diodes.

20. The method of claim 9, further comprising providing a handle affixed to the top panel for easy movement of the monitor apparatus.

* * * * *